US011143457B2

(12) United States Patent
Hata

(10) Patent No.: US 11,143,457 B2
(45) Date of Patent: Oct. 12, 2021

(54) HEAT EXCHANGER

(71) Applicant: DENSO CORPORATION, Kariya (JP)

(72) Inventor: Kenji Hata, Kariya (JP)

(73) Assignee: DENSO CORPORATION, Kariya (JP)

( * ) Notice: Subject to any disclaimer, the term of this patent is extended or adjusted under 35 U.S.C. 154(b) by 352 days.

(21) Appl. No.: 16/303,906

(22) PCT Filed: Apr. 12, 2017

(86) PCT No.: PCT/JP2017/014899

§ 371 (c)(1),
(2) Date: Nov. 21, 2018

(87) PCT Pub. No.: WO2017/203869

PCT Pub. Date: Nov. 30, 2017

(65) Prior Publication Data

US 2020/0318914 A1 Oct. 8, 2020

(30) Foreign Application Priority Data

May 23, 2016 (JP) ..... JP2016-102446

(51) Int. Cl.
*F28D 9/00* (2006.01)
*F28F 3/08* (2006.01)

(52) U.S. Cl.
CPC ..... *F28D 9/005* (2013.01); *F28F 3/08* (2013.01); *F28D 9/0037* (2013.01); *F28F 2215/02* (2013.01); *F28F 2240/00* (2013.01); *F28F 2275/04* (2013.01)

(58) Field of Classification Search
CPC ..... F28D 9/005; F28D 9/0043; F28D 9/0062; F28D 9/0037; F28F 3/10
USPC ..... 165/166
See application file for complete search history.

(56) References Cited

U.S. PATENT DOCUMENTS 2,511,084 A * 6/1950 Shaw ..... F28D 9/0043 165/166
3,601,185 A * 8/1971 Rothman ..... F28F 3/025 165/166
5,511,612 A * 4/1996 Tajima ..... F28D 9/0012 165/167

(Continued)

FOREIGN PATENT DOCUMENTS

CN 102138054 A 7/2011
EP 2726805 A1 5/2014

(Continued)

*Primary Examiner* — Joel M Attey
*Assistant Examiner* — For K Ling
(74) *Attorney, Agent, or Firm* — Harness, Dickey & Pierce, P.L.C.

(57) ABSTRACT

A heat exchanger includes: a duct having an inflow port and an outflow port; a core part; and a fix plate. The core part includes: a plurality of cooling plates, each of which having a first plate portion and a second plate portion stacked with each other; and a plurality of spacer plates. The fix plate is formed in a frame shape corresponding to open form of the inflow port and the outflow port, and is fixed to the inflow port and the outflow port. A tank is fixed to a side of the fix plate opposite from the duct. The core part has a unification part that unites a part of the spacer plate and a part of the cooling plate opposing the spacer plate.

14 Claims, 9 Drawing Sheets

(56) References Cited

U.S. PATENT DOCUMENTS

| | | | | |
|---|---|---|---|---|
| 7,568,520 | B2 * | 8/2009 | Ozawa | F28D 9/0043 138/89 |
| 2010/0300378 | A1 * | 12/2010 | Rigamonti | F24H 1/287 122/18.1 |
| 2011/0168366 | A1 | 7/2011 | Garret et al. | |
| 2014/0216700 | A1 | 8/2014 | Odillard et al. | |

FOREIGN PATENT DOCUMENTS

| | | | |
|---|---|---|---|
| JP | 6-257983 | A | 9/1994 |
| JP | H09273886 | A | 10/1997 |
| JP | 2011117715 | A | 6/2011 |
| JP | 2014214955 | A | 11/2014 |

* cited by examiner

HEAT EXCHANGER

CROSS REFERENCE TO RELATED APPLICATIONS

This application is a U.S. National Phase Application under 35 U.S.C. 371 of International Application No. PCT/JP2017/014899 filed on Apr. 12, 2017. This application is based on and claims the benefit of priority from Japanese Patent Application No. 2016-102446 filed on May 23, 2016. The entire disclosures of all of the above applications are incorporated herein by reference.

TECHNICAL FIELD

The present disclosure relates to a heat exchanger in which a core is housed in a duct.

BACKGROUND ART

Conventionally, a heat exchanger is proposed, in which plural tubes are fixed to a pair of core plates, for example, in Patent Literature 1. Specifically, each core plate is inserted and joined to the ends of the tubes. The core plate is fixed to an opening of a tank part having a pipe shape in which gas circulates. Thereby, heat is exchanged between cooling fluid flowing through the tubes and gas flowing through the tank part.

PRIOR ART LITERATURES

Patent Literature

Patent Literature 1: JP 2014-214955 A

SUMMARY OF INVENTION

However, since each tube is fixed to each core plate in the conventional art, the tube is expanded and contracted in the longitudinal direction of the tube by heat of gas, such that thermal distortion is generated to a fix portion of the tube fixed to the core plate. In case where the gas which flows through a tank part is supercharged air supplied to an internal-combustion engine for combustion, since the tube is exposed to high-temperature air, excessive thermal distortion is generated to the fix portion by the expansion and contraction of the tube.

Then, in order to secure properties withstanding the thermal distortion, the inventors study a heat exchanger including a core part in which heat is exchanged between cooling fluid and supercharged air, a duct, and a tank connected to an internal-combustion engine. The duct houses the core part, and the supercharged air flows through the duct.

The core part has plural cooling plates stacked with each other to define a space in which the cooling fluid circulates, and another space is defined between the cooling plates for flowing the supercharged air. The tank is fixed to the duct through a frame-shaped plate corresponding to a connector. That is, the frame-shaped plate is restrained by the duct.

Furthermore, in order to distribute the cooling fluid to each space of the cooling plate, the cooling plate has a cup part with an opening and projected in the stacking direction of the cooling plates. The openings of the cup parts are joined to each other in the stacking direction. Thereby, the cooling fluid flows in the stacking direction through the cup parts, and is distributed to each layer of the cooling plates.

Since a core plate becomes unnecessary in this configuration, the cooling plate is not restrained by the core plate. Therefore, the properties withstanding the thermal distortion improves compared with the conventional art.

However, the core part is cooled by the cooling fluid, while the frame-shaped plate is heated by high-temperature supercharged air. For this reason, a temperature difference between the core part and the frame-shaped plate deforms the frame-shaped plate restrained by the duct to press the core part from the both sides. Thereby, a thermal distortion is generated in the core part, and the cup part may be damaged.

It is an object of the present disclosure to provide a heat exchanger in which a thermal distortion applied to a cup part can be reduced.

According to an aspect of the present disclosure, a heat exchanger includes a duct in which a first fluid is introduced from an inflow port and discharged out of an outflow port.

The heat exchanger includes a core part housed in the duct. The core part includes cooling plates and spacer plates. The cooling plate has a first plate portion and a second plate portion stacked with each other, and a channel for a second fluid is defined between the first plate portion and the second plate portion. The spacer plate is supported between the cooling plates adjacent to each other. Heat is exchanged between the first fluid flowing through the duct and the second fluid flowing between the cooling plates.

The heat exchanger includes a fix plate having a frame shape corresponding to an open form of the inflow port and the outflow port. The fix plate is fixed to the inflow port and the outflow port, and a tank is fixed to a side of the fix plate opposite from the duct.

The cooling plate may have a first cup part, with an opening, defined by a part of the first plate portion projected away from the second plate portion, and a second cup part, with an opening, defined by a part of the second plate portion corresponding to the first cup part and projected away from the first cup part. The first cup part and the second cup part may be stacked with each other.

The spacer plate may have a penetration hole part that defines a pillar structure part in which the plural cooling plates are connected through the first cup part and the second cup part from the most top layer to the most bottom layer in the stacking direction of the cooling plates. The spacer plate is supported between the second cup part of one cooling plate and the first cup part of the adjacent cooling plate.

The core part has a unification part that unites a part of the spacer plate and a part of the cooling plate opposing the spacer plate.

The core part may have a unification part that unites the spacer plates adjacent to each other.

The core part may have a unification part that unites the cooling plates adjacent to each other.

Accordingly, the cooling plate and the spacer plate are restrained by the unification part, the spacer plates are restrained by the unification part, or the cooling plates are restrained by the unification part, such that the rigidity of the cooling plate improves. For this reason, the cooling plate can be restricted from deforming if the fix plate is deformed to press the core part from both sides in the stacking direction of the cooling plates. Therefore, a thermal distortion applied to each cup part can be reduced.

DESCRIPTION OF EMBODIMENTS

Figure 1:
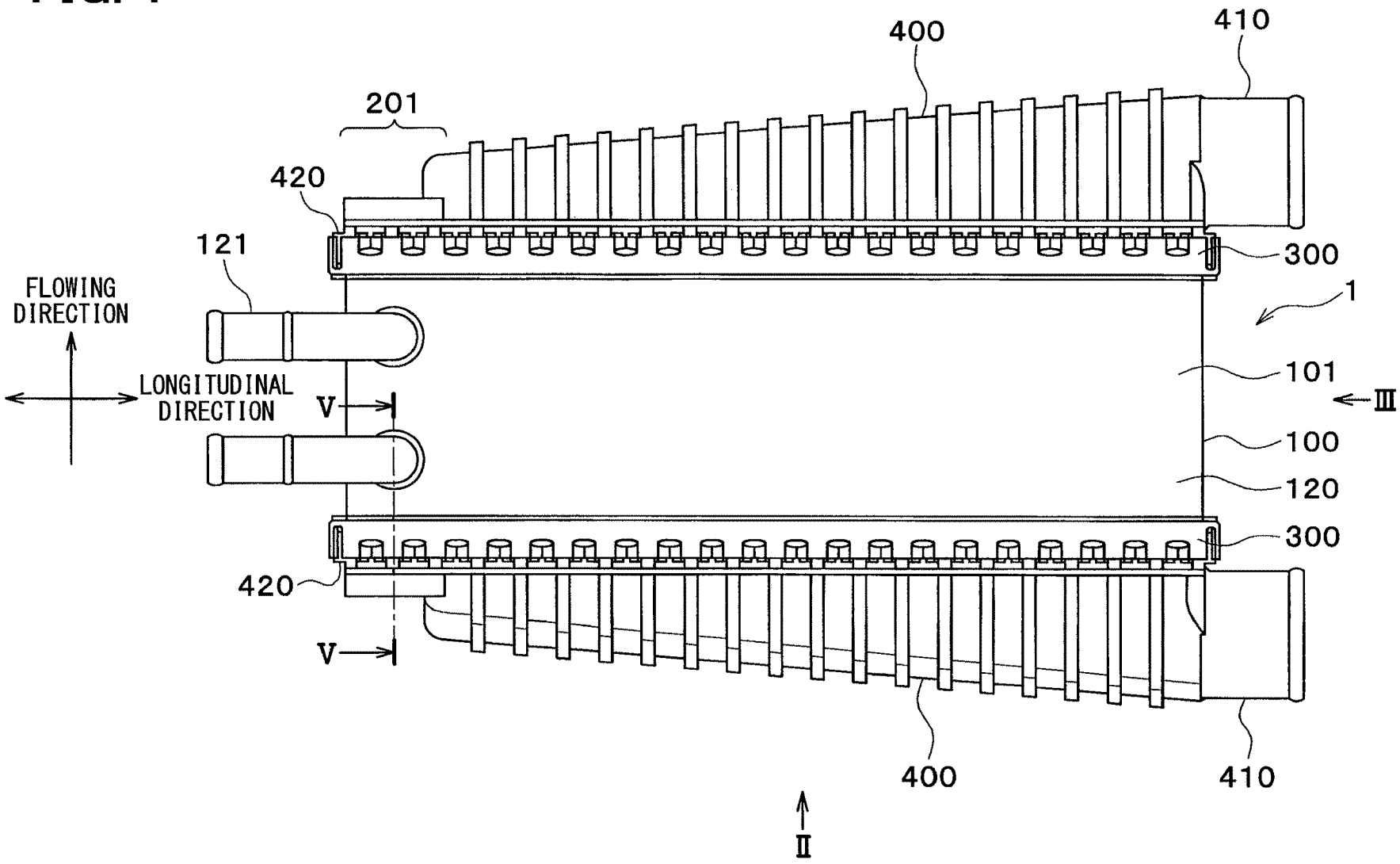
FIG. 1 is a plan view illustrating a heat exchanger according to a first embodiment.

Hereinafter, embodiments will be described according to the drawings. Same or equivalent portions among respective embodiments below are labeled with same reference numerals in the drawings.

First Embodiment

A first embodiment is described with reference to the drawings. A heat exchanger of this embodiment is used as a water cooling system intercooler which cools intake air by heat exchange between cooling water and high-temperature supercharged air pressurized by a turbocharger.

As shown in FIG. 1 to FIG. 4, a heat exchanger 1 includes a duct 100, a core part 200, a fix plate 300, and a tank 400.

Figure 3:
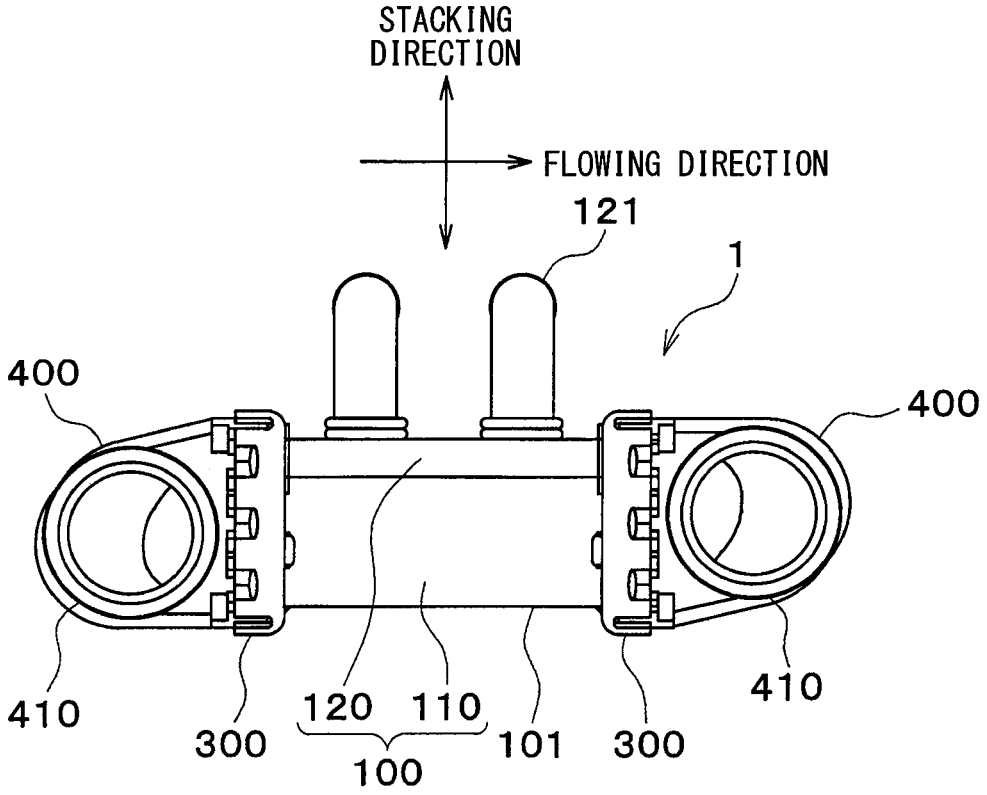
FIG. 3 is a view seen in an arrow direction III of FIG. 1.

The duct 100 is a pipe component in which the supercharged air flows as a first fluid. As shown in FIG. 3, the duct 100 includes a first duct plate 110 and a second duct plate 120, each of which is press-processed of a thin board made of metal such as aluminum to have a predetermined form, combined with each other.

Figure 4:
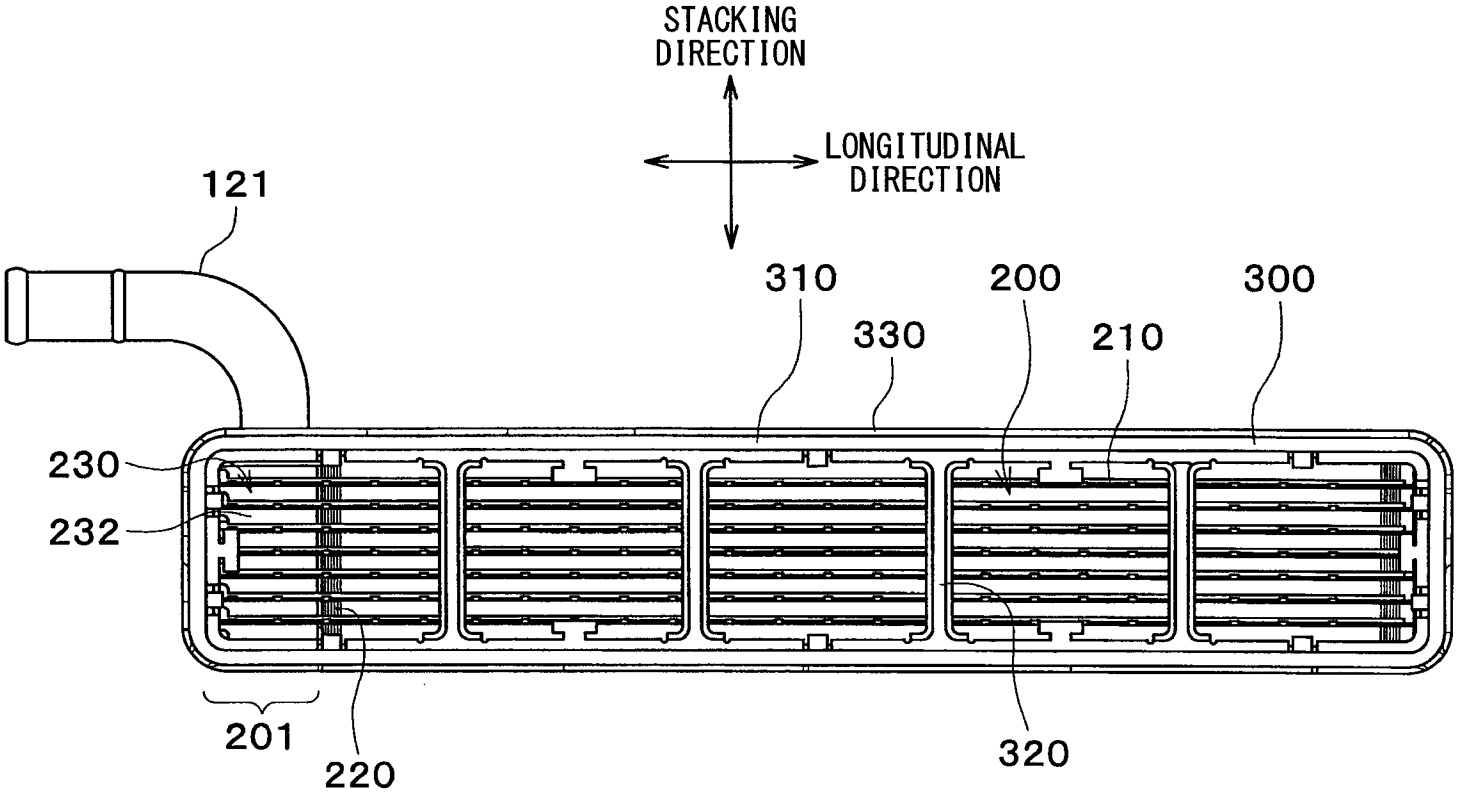
FIG. 4 is a view seen in the arrow direction II of FIG. 1, in which a tank is omitted.

The duct 100 has an inflow port from which the supercharged air is introduced and an outflow port from which the supercharged air is discharged. The supercharged air flows into an intake channel defined inside the duct 100 from the inflow port of the duct 100. The supercharged air flows through the intake channel, and flows out of the outflow port of the duct 100. That is, as shown in FIG. 1 and FIG. 3, the supercharged air flows inside the duct 100 along the flowing direction. As shown in FIG. 4, the inflow port and the outflow port of the duct 100 are formed in approximately rectangle. Although FIG. 1 illustrates a specific flowing direction of the supercharged air, the supercharged air may flow in an opposite direction.

The second duct plate 120 has a cooling-water pipe 121 to which a non-illustrated piping is connected for the cooling water as a second fluid. The heat exchanger 1 is connected with a non-illustrated heat exchanger which cools the cooling water through the piping.

The core part 200 is a heat exchange part in which heat is exchanged between the cooling water and the supercharged air flowing in the duct 100. The core part 200 is housed in the duct 100. The core part 200 is made of metal component such as aluminum. As shown in FIG. 4, the core part 200 has a cooling plate 210, an outer fin 220, and a spacer plate 230.

Figure 5:
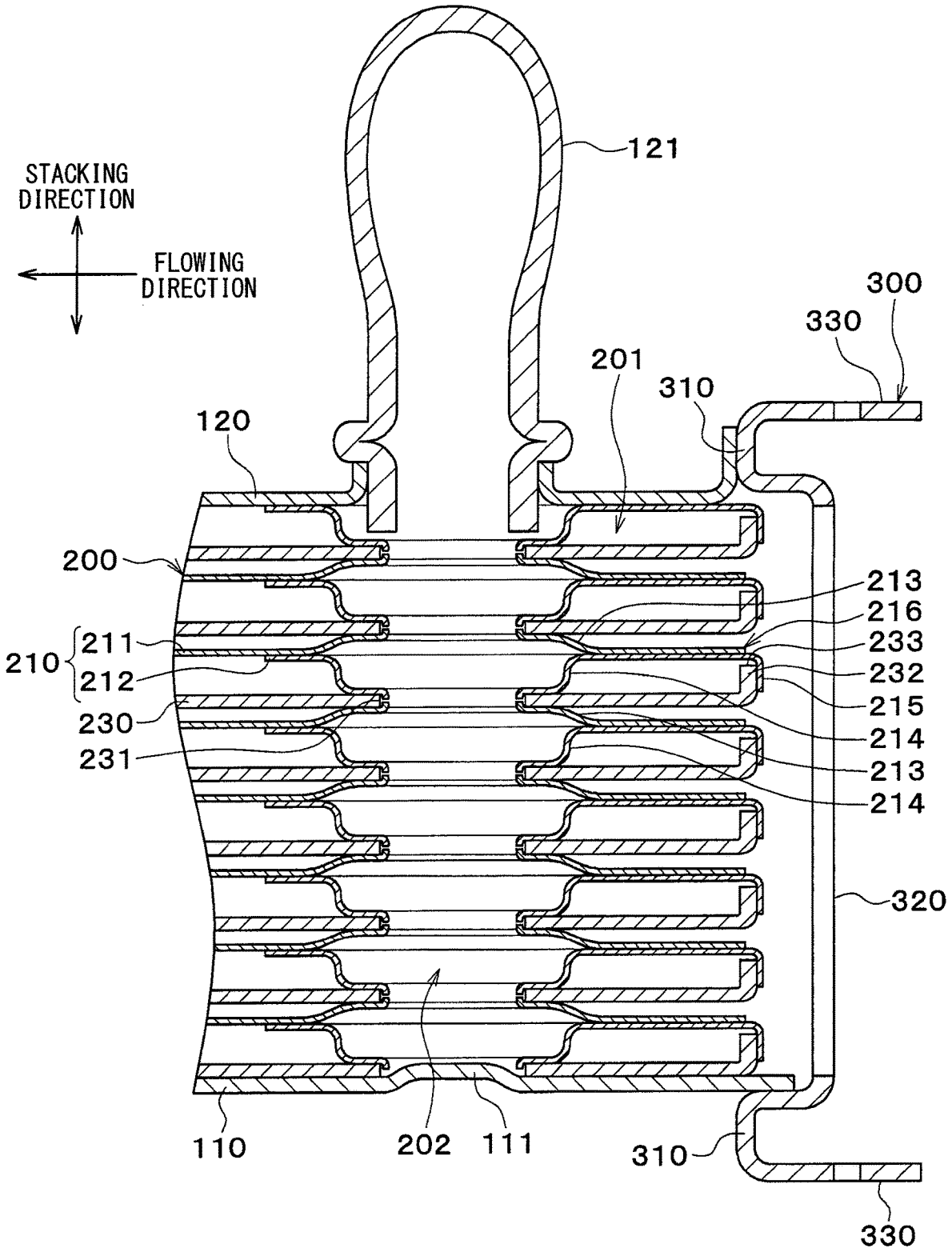
FIG. 5 is a sectional view taken along a line V-V of FIG. 1.

The cooling plate 210 defines a channel in which the cooling water flows. As shown in FIG. 5, the cooling plate 210 has a first plate portion 211 and a second plate portion 212 stacked with each other, and defines a non-illustrated channel for the cooling water between the plate portions 211 and 212. A non-illustrated inner fin is disposed in the channel to facilitate heat exchange by increasing the heat transfer area.

The cooling plate 210 has the plate portions 211 and 212 stacked with each other by, for example, bending one board component. The plural cooling plates 210 are stacked to each other with a fixed interval. The cooling plate 210 located at the most top layer includes only the second plate portion 212.

The cooling plate 210 has a first cup part 213 and a second cup part 214. The first cup part 213 is a portion of the first plate portion 211 projected away from the second plate portion 212 and has an opening. The second cup part 214 is a portion of the second plate portion 212 corresponding to the first cup part 213, and is projected away from the first cup part 213 and has an opening.

The outer fin 220 is disposed in a range of the core part 200 except an outflow/inflow part 201. In this range, the cooling plate 210 and the outer fin 220 are alternately stacked with each other. In FIG. 4, the outer fin 220 is partially illustrated in the longitudinal direction, and the illustration of the other outer fin 220 is omitted.

The core part 200 is defined to have the outflow/inflow part 201 within a fixed range adjacent to the cooling-water pipe 121 for the cooling water relative to the core part 200 in a direction intersecting both the flowing direction of the supercharged air and the stacking direction of the cooling plates 210, that is, in the longitudinal direction of the core part 200 shown in FIG. 1.

The cooling plates 210 are stacked with each other in the outflow/inflow part 201, such that the second cup part 214 of one cooling plate 210 opposes the first cup part 213 of the adjacent cooling plate 210 in the stacking direction of the cooling plates 210.

The spacer plate 230 is a board-shaped component disposed in the outflow/inflow part 201 of the core part 200. The spacer plate 230 is supported between the cooling plates 210 adjacent to each other.

As shown in FIG. 5, specifically, the spacer plate 230 has a penetration hole part 231 and a wall part 232. The penetration hole part 231 is a hole part for connecting the second cup part 214 of one cooling plate 210 and the first cup part 213 of the adjacent cooling plate 210 in the stacking direction. The penetration hole part 231 is defined between the second cup part 214 of one cooling plate 210 and the first cup part 213 of the adjacent cooling plate 210. Thereby, a pillar structure part 202 is defined by all of the cooling plates 210 connected through the first cup part 213 and the second cup part 214 from the most top layer to the most bottom layer. The pillar structure part 202 is included in the outflow/inflow part 201 of the core part 200 in the longitudinal direction. The penetration hole part 231 is a part of the pillar structure part 202.

In this embodiment, the open end of the second cup part 214 of one cooling plate 210 and the open end of the first cup part 213 of the adjacent cooling plate 210 are separated from each other. The open ends may be joined with each other. Each open end may not be located at the hole part of the penetration hole part 231. That is, each open end may be joined to a board surface of the spacer plate 230.

The first duct plate 110 of the duct 100 has a projection part 111 at a position corresponding to the penetration hole part 231 of the spacer plate 230 at the most bottom layer, in addition to the second cup part 214 of the cooling plate 210 located on the spacer plate 230.

The spacer plate 230 has an end 233 adjacent to the inflow port at least, and the wall part 232 is a portion of the end 233 bent toward one cooling plate 210. The wall part 232 may also be formed in the end of the spacer plate 230 adjacent to the outflow port. As mentioned above, the outflow/inflow part 201 is a portion of the core part 200 where the cooling water flows in or out, and is a portion which does not contribute to heat exchange. Therefore, the wall part 232 restricts the supercharged air from flowing into the outflow/inflow part 201 from the tank 400.

Each of the cooling plates 210 has a nail part 215. The nail part 215 is defined by the end 216 of the cooling plate 210 by bending the tip of the second plate portion 212 toward the wall part 232. The nail part 215 is joined to the wall part 232 by brazing. Thereby, the nail part 215 and the wall part 232 are united. The nail part 215 and the wall part 232 may be joined by adhesion or welding.

In this embodiment, each of the cooling plates 210 is united with the spacer plate 230 corresponding to each cooling plate 210 by the nail part 215 and the wall part 232. Specifically, when the spacer plate 230 and the cooling plate 210 that opposes the spacer plate 230 are defined as one layer, the nail part 215 is formed in all the layers. The nail part 215 may be formed in a part of the layers.

The cooling water flows in or out of the outflow/inflow part 201 of the core part 200 through the cooling-water pipe 121. The cooling water is distributed or gathered relative to each layer of the cooling plates 210 through the pillar structure part 202. Supercharged air passes between the cooling plates 210. Thereby, the core part 200 performs heat exchange between the supercharged air and the cooling water.

The fix plate 300 fixes the duct 100 in the state where the duct 100 is maintained to have the pipe shape, and is a connector connecting the tank 400 to the duct 100 to fix the tank 400. The fix plate 300 is formed by press-processing a metal thin board such as aluminum. The fix plate 300 is formed in a frame shape of approximately rectangle corresponding to the opening form of the inflow port and the outflow port of the duct 100. The fix plate 300 is fixed to each of the inflow port and the outflow port of the duct 100.

As shown in FIG. 4 and FIG. 5, the fix plate 300 has a groove portion 310, a beam portion 320, and a wave fix portion 330.

The groove portion 310 is a portion of the fix plate 300 recessed toward the duct 100 along the inflow port and the outflow port of the duct 100, and the open end of the tank 400 is inserted into the groove portion 310. The groove portion 310 is a portion of the fix plate 300 fixed to the duct 100.

The beam portion 320 is a portion of the fix plate 300 which connects two different places of the fix plate 300. The beam portion 320 connects one long side of the fix plate 300 and the other long side of the fix plate 300. In this embodiment, the four beam portions 320 are defined in the fix plate 300. The beam portion 320 restricts distortion and deformation of the fix plate 300 formed by press processing.

Figure 2:
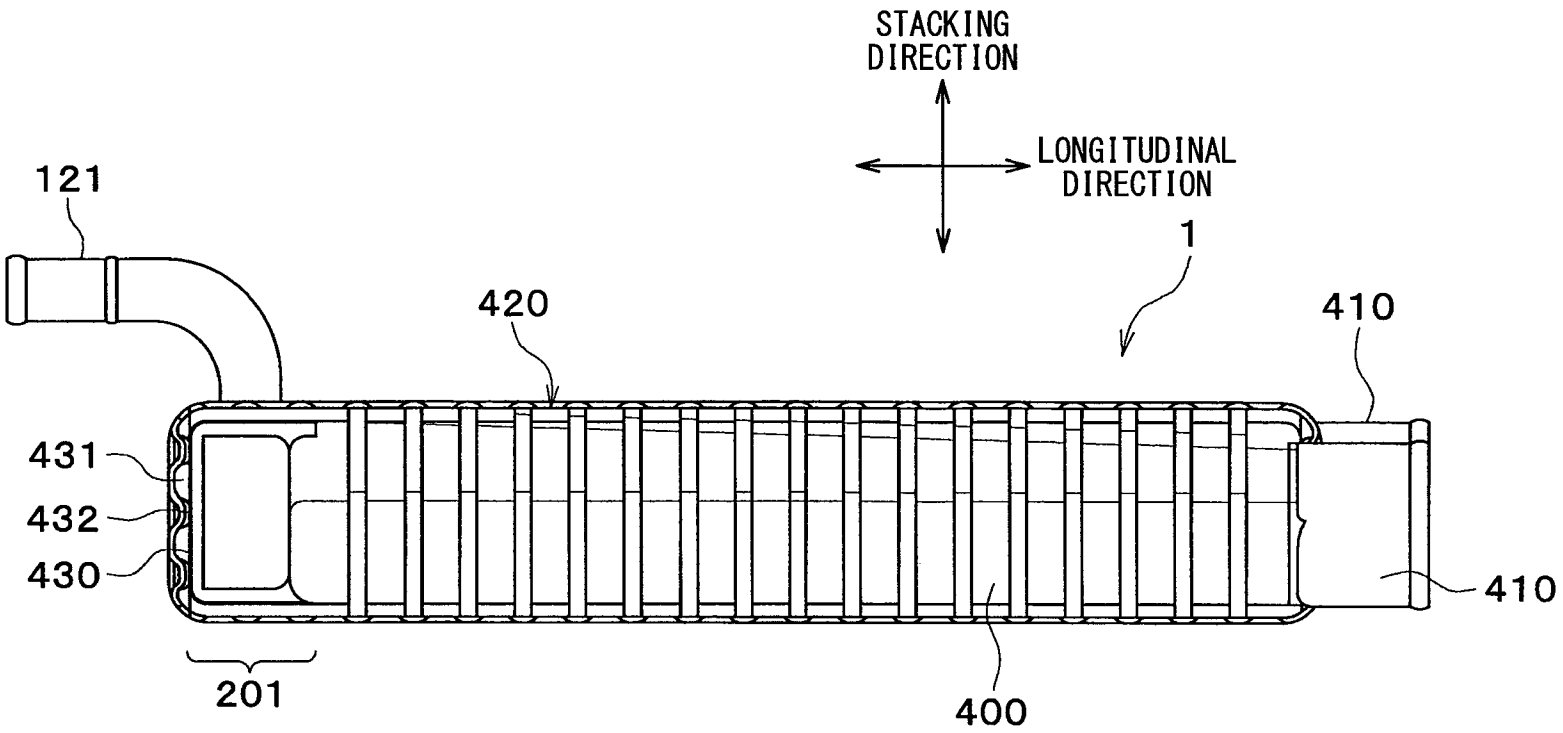
FIG. 2 is a view seen in an arrow direction II of FIG. 1.

The tank 400 is fixed to the fix plate 300 along the wave fir portion 330 by plastically deforming the wave fir portion 330. The wave fix portion 330 is connected to the groove portion 310. FIG. 4 illustrates the form of the wave fix portion 330 before the deformation, and FIG. 1 to FIG. 3 illustrate the form of the wave fix portion 330 after the deformation.

The tank 400 is a piping in which the supercharged air circulates. The tank 400 is arranged on a side of the fix plate 300 opposite from the duct 100 and the core part 200. As shown in FIG. 1 and FIG. 2, the tank 400 has a supercharged-air pipe 410, an opening 420, and a perimeter part 430.

The supercharged-air pipe 410 is an inlet and outlet of the tank 400 for the supercharged air. The supercharged-air pipe 410 is connected to a turbocharger through piping which is not illustrated. The opening 420 is a portion of the tank 400 inserted in the groove portion 310 of the fix plate 300.

The perimeter part 430 is a portion of the opening 420 corresponding to the wave fix portion 330 of the fix plate 300. The whole of the perimeter part 430 is fixed by plastically deforming the wave fix portion 330. As shown in FIG. 2, the perimeter part 430 has a crest part 431 and a valley part 432 formed along the perimeter of the opening 420. The crest part 431 and the valley part 432 are alternately arranged in the circumferential direction of the opening 420.

The wave fix portion 330 covers the perimeter part 430 of the tank 400, and a part of the wave fix portion 330 corresponding to the valley part 432 has a shape corresponding to the valley part 432. Therefore, the whole of the perimeter part 430 is fixed by plastically deforming the wave fix portion 330 with the wave shape.

When the tank 400 is inserted in the fix plate 300, the perimeter part 430 is covered with the wave fix portion 330, and a part of the wave fix portion 330 corresponding to the valley part 432 is pushed into the valley part 432 by a punch which is not illustrated, such that the fixing by the plastic deformation can be achieved. Accordingly, the part of the wave fix portion 330 corresponding to the valley part 432 is deformed toward the valley part 432.

All the parts of the wave fix portion corresponding to the valley part 432 are deformed by the punch. Thus, the tank 400 is fixed on the fix plate 300 by the plastic deformation.

Next, the effect of the nail part 215 define in the end 216 of the cooling plate 210 is explained. Inventors analyze a thermal distortion applied to each cup part 213, 214 of the pillar structure part 202 in simulations when the supercharged air flows in the tank 400 such that the fix plate 300 is heated at least on a side of the inflow port of the duct 100.

Figure 6:
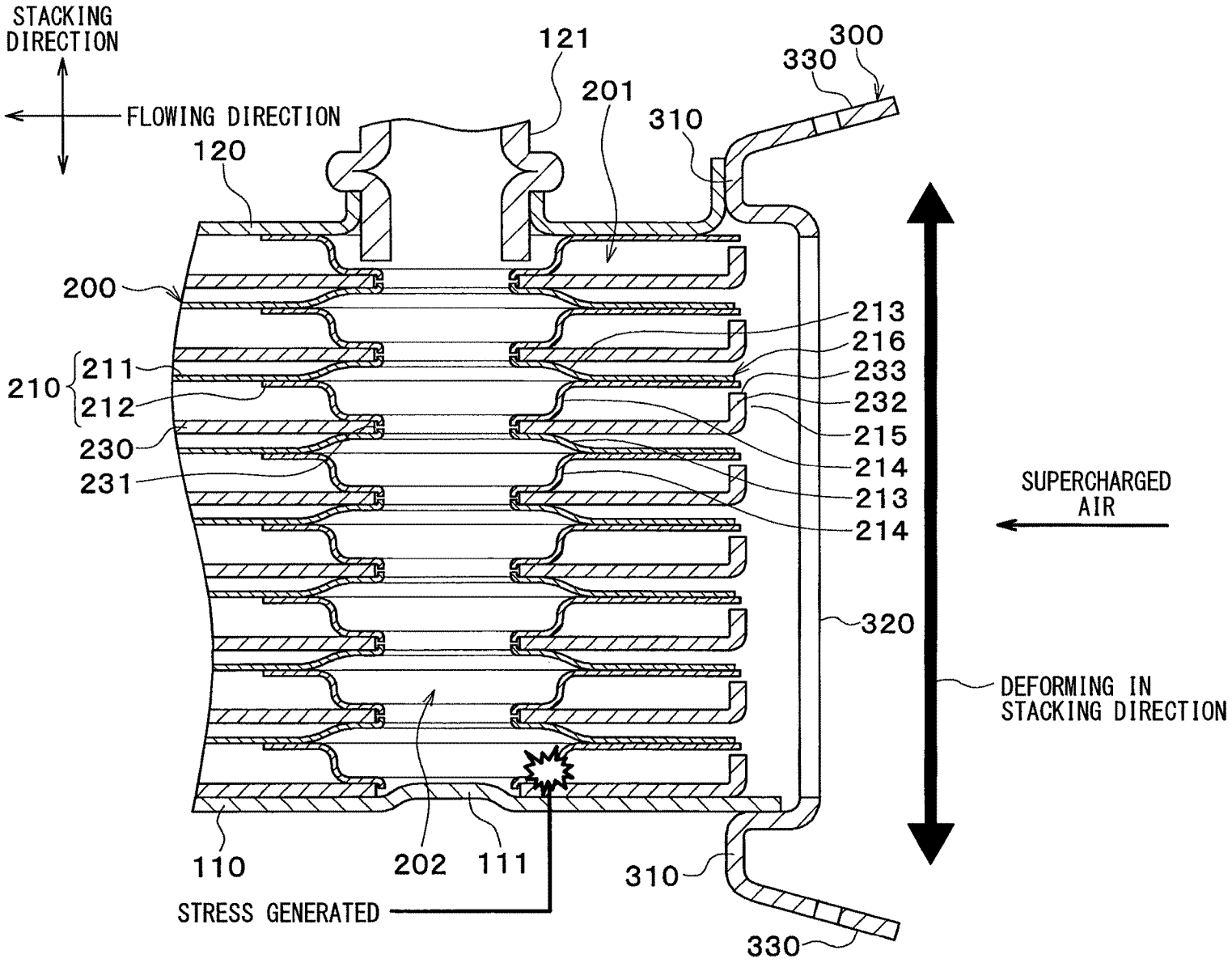
FIG. 6 is a sectional view illustrating a pillar structure part, in which a fix plate is deformed in a configuration not having a nail part.

First, when the fix plate 300 is heated by supercharged air, the fix plate 300 expands in the longitudinal direction. However, the fix plate 300 is restrained by the duct 100 in the longitudinal direction. For this reason, as shown in FIG. 6, the fix plate 300 is deformed in the stacking direction.

In case where the cooling plate 210 has no nail part 215, the wave fix portions 330 of the fix plate 300 are deformed in the stacking direction to separate from each other. In other words, the groove portion 310 of the fix plate 300 is deformed to press the duct 100 from the both sides. Thereby, the pillar structure part 202 of the core part 200 is pressed by the duct 100, and a thermal distortion is applied to each cup part 213, 214. Excessive thermal distortion is applied to the second cup part 214 in contact with the spacer plate 230 at the most bottom layer, and the core part 200 is damaged. In FIG. 6, the cooling-water pipe 121 is omitted.

In contrast, according to the present embodiment, the nail part 215 is united with the wall part 232, and the end 216 of the cooling plate 210 is restrained by the wall part 232 of the spacer plate 230 due to the nail part 215. For this reason, the rigidity of the cooling plate 210 improves. Therefore, the cooling plate 210 can be restricted from deforming even when the fix plate 300 is deformed.

Specifically, according to the analysis result, if a thermal distortion is defined as 100 in case where the cooling plate 210 has no nail part 215, a thermal distortion is 79 in case where the nail part 215 is united with the wall part 232. That is, the thermal distortion applied to each cup part 213, 214 can be reduced by the nail part 215 by 21%. Therefore, the thermal distortion applied to each cup part 213, 214 can be reduced by the nail part 215. As a result, the properties of the heat exchanger 1 withstanding the thermal distortion can be raised.

In this embodiment, the nail part 215 corresponds to a "unification part."

Second Embodiment

Figure 7:
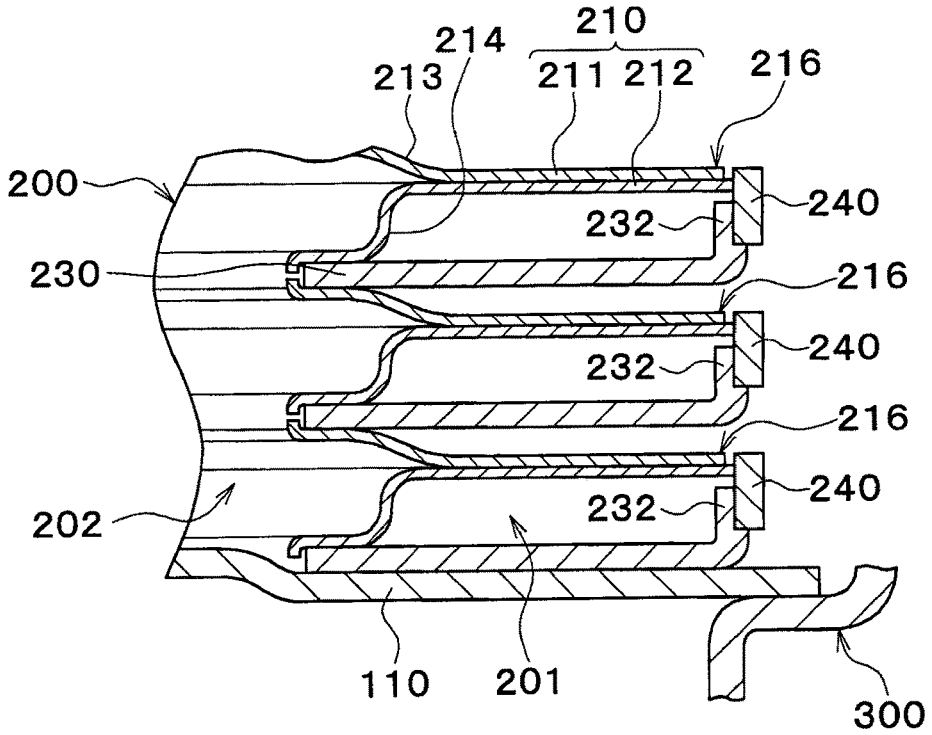
FIG. 7 is a partial sectional view illustrating a pillar structure part according to a second embodiment.

A second embodiment is explained in a different portion different from the first embodiment. As shown in FIG. 7, the core part 200 has a holding part 240. The holding part 240 is a different component different from the cooling plate 210 and the spacer plate 230.

The holding part 240 is, for example, defined by a plate component. The holding part 240 is disposed in each pair of the cooling plate 210 and the spacer plate 230. Thus, the end 216 of the cooling plate 210 and the wall part 232 of the spacer plate 230 is united by the holding part 240 without forming the nail part 215 in the end 216 of the cooling plate 210.

In this embodiment, the holding part 240 corresponds to a "unification part."

Third Embodiment

Figure 8:
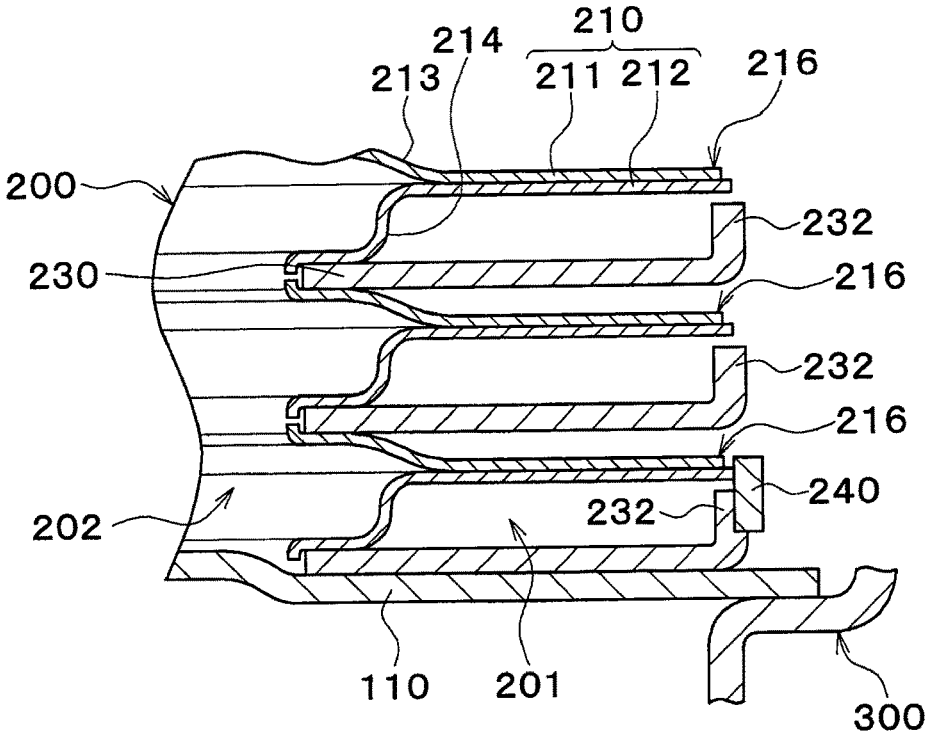
FIG. 8 is a partial sectional view illustrating a pillar structure part according to a third embodiment.

A third embodiment is explained in a different portion different from the first and second embodiments. As shown in FIG. 8, the holding part 240 is disposed in a part, not all, of the pairs of the cooling plate 210 and the spacer plate 230. For this reason, the cooling plates 210 are restrained partially. Therefore, the rigidity of the cooling plates 210 can be raised partially.

As shown in FIG. 8, for example, the holding part 240 is provided to the cooling plate 210 at the most bottom layer to which excessive thermal distortion is applied, and the holding part 240 is not formed to the upper layers of the cooling plates 210.

Fourth Embodiment

A fourth embodiment is explained in a different portion different from the first to the third embodiments, in which the end 216 of the cooling plate 210 and the end 233 of the spacer plate 230 are united by the nail part 215 or the holding part 240, as an example of unification. The united portion is not restricted to the ends 216 and 233, while a part of the spacer plate 230 and a part of the cooling plate 210 which opposes the spacer plate 230 are united.

Figure 9:
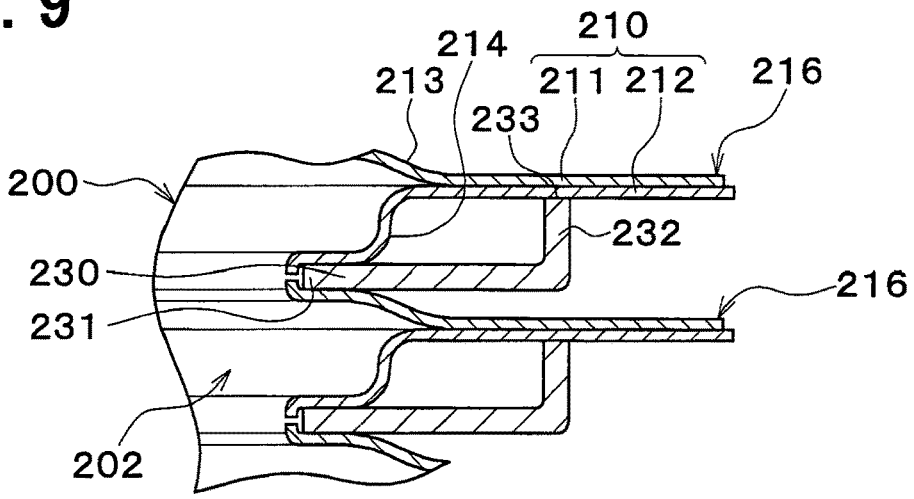
FIG. 9 is a partial sectional view illustrating a pillar structure part according to a fourth embodiment.

For example, as shown in FIG. 9, the wall part 232 of the spacer plate 230 is united with the cooling plate 210 at a location between the end 216 and the cup part 213, 214. Alternatively, the end 216 of the cooling plate 210 may be united with the spacer plate 230 at a location between the end 233 and the penetration hole part 231.

Fifth Embodiment

Figure 10:
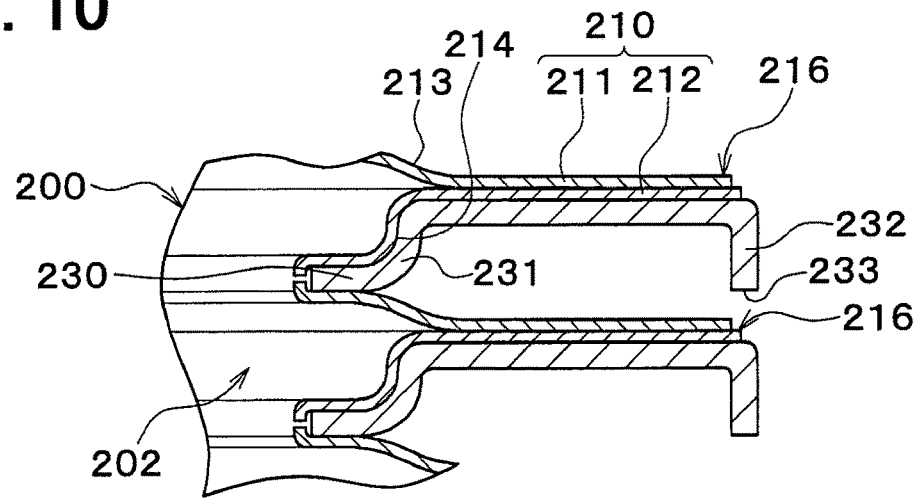
FIG. 10 is a partial sectional view illustrating a pillar structure part according to a fifth embodiment.

A fifth embodiment is explained in a different portion different from the first to the fourth embodiments. As shown in FIG. 10, the penetration hole part 231 is formed to cover the second cup part 214 of one cooling plate 210. The penetration hole part 231 formed as such is united with the second cup part 214. The end 233 of the cooling plate 210 is bent toward the adjacent cooling plate 210 to define the wall part 232. Accordingly, since the second cup part 214 is restrained by the penetration hole part 231, the rigidity of the second cup part 214 can be raised.

The penetration hole part 231 may be formed to cover the first cup part 213 of the adjacent cooling plate 210. In this case, the penetration hole part 231 formed as such is united with the first cup part 213. Moreover, the wall part 232 may not be formed in the spacer plate 230. In this embodiment, the penetration hole part 231 corresponds to a "unification part."

Sixth Embodiment

Figure 11:
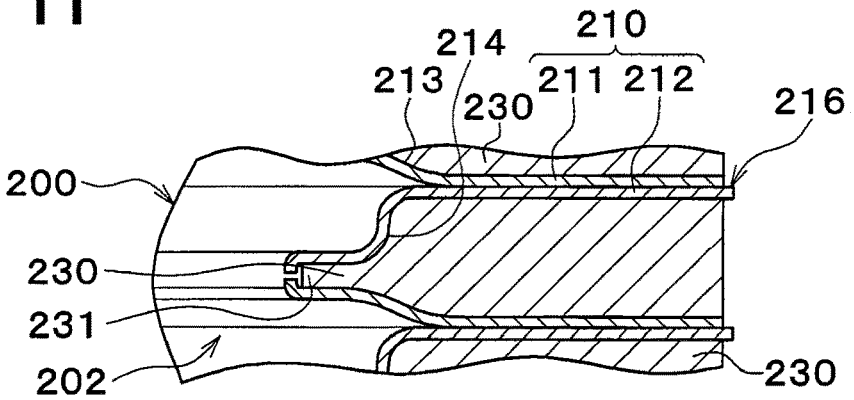
FIG. 11 is a partial sectional view illustrating a pillar structure part according to a sixth embodiment.

A sixth embodiment is explained in a different portion different from the first to the fifth embodiments. As shown in FIG. 11, the spacer plate 230 is formed to fill a gap between the cooling plates 210 adjacent to each other through the spacer plate 230. Moreover, the spacer plate 230 is united with both of the adjacent cooling plates 210.

In this embodiment, the penetration hole part 231 is formed to cover both the second cup part 214 of one cooling plate 210 and the first cup part 213 of the adjacent cooling plate 210. Thus, the cooling plate 210 is formed to raise the rigidity of the cooling plate 210 as a whole.

In this embodiment, the spacer plate 230 corresponds to a "unification part."

Seventh Embodiment

Figure 12:
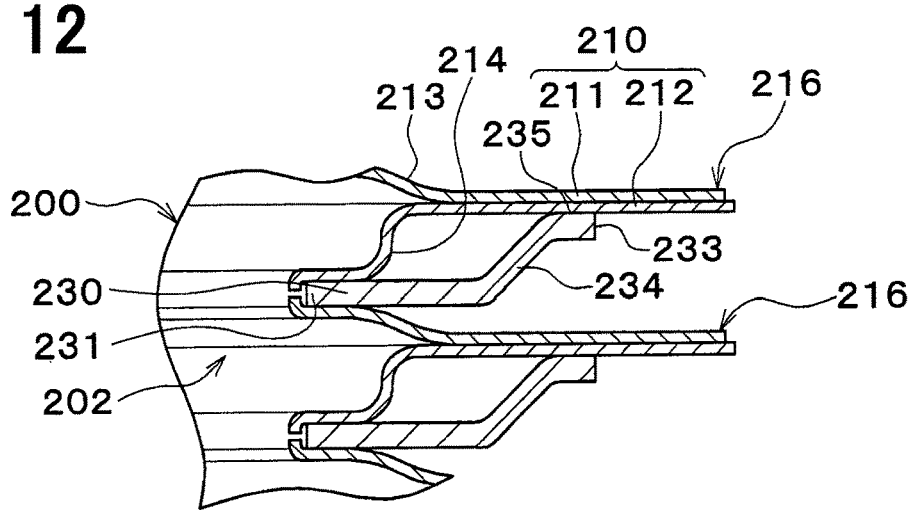
FIG. 12 is a partial sectional view illustrating a pillar structure part according to a seventh embodiment.

A seventh embodiment is explained in a different portion different from the first to the sixth embodiments. As shown in FIG. 12, the spacer plate 230 has a bent part 234 between the penetration hole part 231 and the end 233. The bent part 234 is a portion of the end 233 of the spacer plate 230 bent to make a wall surface 235 of the end 233 opposing the cooling plate 210 to be in contact with the cooling plate 210.

The wall surface 235 of the end 233 of the spacer plate 230 is pressed onto and united with one cooling plate 210 at a location between the end 216 and the cup part 213, 214, due to the bent part 234. Thus, the end 233 of the spacer plate 230 may be united with the cooling plate 210. That is, since the wall surface 235 is in surface contact with the cooling plate 210 and brazed to the cooling plate 210, the connection strength can be raised.

The end 233 of the spacer plate 230 may be united with one cooling plate 210 at a location adjacent to the end 216. Moreover, the end 233 of the spacer plate 230 may be united with the adjacent cooling plate 210. In this embodiment, the end 233 of the spacer plate 230 corresponds to a "unification part."

Eighth Embodiment

Figure 13:
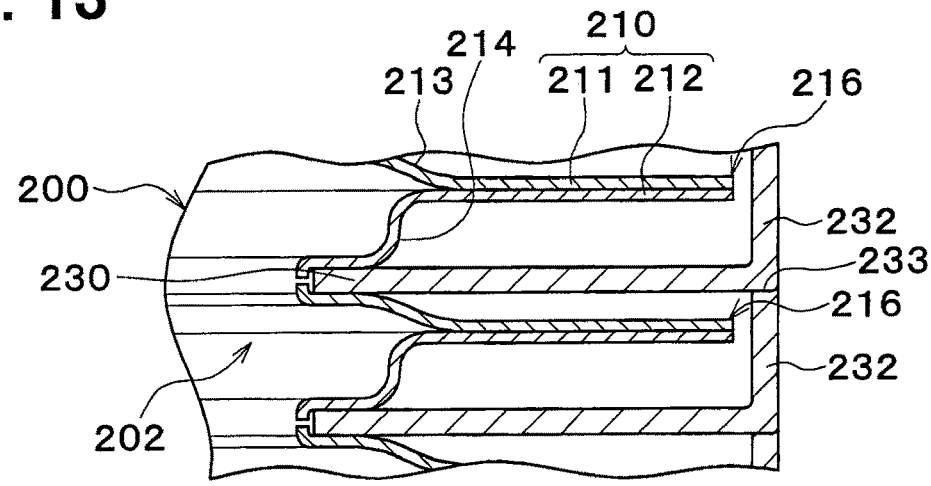
FIG. 13 is a partial sectional view illustrating a pillar structure part according to an eighth embodiment.

An eighth embodiment is explained in a different portion different from the first to the seventh embodiments. As shown in FIG. 13, the wall part 232 of one spacer plate 230 and the wall part 232 of the adjacent spacer plate 230 are united. Since the rigidity of the spacer plate 230 improves, the properties of each cup part 213, 214 of the cooling plate 210 withstanding the thermal distortion can be raised.

When one and the other spacer plates 230 adjacent to each other is defined to form one layer, the unification of the wall parts 232 is defined in all the layers. Similarly to the third embodiment, the unification of the wall parts 232 may be defined in a part of the layers.

As mentioned above, the ends 233 of the spacer plates 230 may be connected with each other. The connection of the spacer plates 230 is not restricted at the ends 233. Specifically, the space plates 230 may be connected at a location between the penetration hole part 231 and the end 233. Similarly to the second embodiment, the spacer plates 230 may be united by the holding part 240. In this embodiment, the spacer plate 230 and the wall part 232 correspond to a "unification part."

Ninth Embodiment

Figure 14:
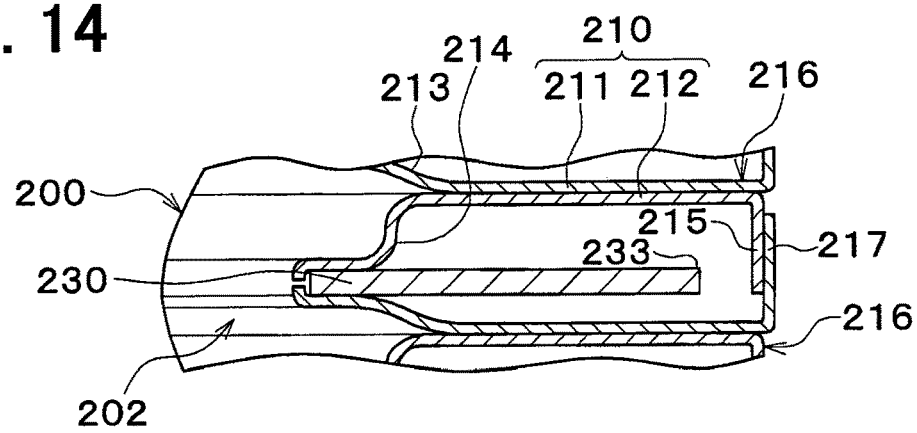
FIG. 14 is a partial sectional view illustrating a pillar structure part according to a ninth embodiment.

A ninth embodiment is explained in a different portion different from the first to the eighth embodiments. As shown in FIG. 14, one and the other of the plural cooling plates 210 adjacent to each other are united. Specifically, a nail part 215 of the second plate portion 212 of one cooling plate 210 is united with a nail part 217 of the first plate portion 211 of the adjacent cooling plate 210 defined by bending the tip portion toward the one cooling plate 210.

When one and the other cooling plates 210 adjacent to each other is defined to form one layer, the unification of the cooling plates 210 is defined in all the layers. Similarly to the third embodiment, the unification of the cooling plates 210 adjacent to each other may be defined in a part of the layers.

As mentioned above, the ends 216 of the cooling plates 210 may be connected with each other. The connection of the cooling plates 210 is not restricted to the nail parts 215, 217. Alternatively, the cooling plates 210 may be connected at a location between the end 216 and each cup part 213, 214. Similarly to the second embodiment, the cooling plates 210 may be united by the holding part 240. In this embodiment, the cooling plate 210 and the nail parts 215, 217 correspond to a "unification part."

Other Embodiment

The heat exchanger 1 of each embodiment is an example, and is not limited to the above configuration. The present disclosure may be implemented by modifying the above configuration. For example, although the heat exchanger 1 is used as a water cooling system intercooler as an example, the heat exchanger 1 may be applied to other uses.

In the first embodiment, the nail part 215 of the end 216 of each cooling plate 210 is formed at the tip end of the second plate portion 212. Alternatively, the nail part 215 may be formed at the tip end of the first plate portion 211, and may be prepared in both of the plate portions 211 and 212. The tip end of the wall part 232 of the spacer plate 230 may be united with the end 216 of the cooling plate 210.

In each of the embodiments, the wall part 232 and the end 216 of the cooling plate 210 are united by brazing or adhesion, but the other methods may be adopted. For example, the wall part 232 and the end 216 of the cooling plate 210 may be united by plastically deforming to fix or press-fitting. In the method of plastically deforming to fix, preparing a hole in one side, inserting a tip portion of the other side in the hole, and bending the tip portion to fix the one side by the other side. In the press-fitting method, preparing a hole in one side, and press-fitting a tip portion of the other side in the hole.

The present disclosure is not limited to each of the embodiments, and can be suitably changed within a range of the appended claims.

What is claimed is:

1. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites a part of the spacer plate and a part of the cooling plate opposing the spacer plate, the spacer plate has an end adjacent to at least the inflow port, and the end has a wall surface opposing the cooling plate, and a bent part bent to make the wall surface to be in contact with the cooling plate, the unification part is the end of the spacer plate having the wall surface united with the cooling plate by the bent part, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the plurality of spacer plates has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, and the pillar structure part is defined by the first cup part and the second cup part from the most top layer to the most bottom layer of the cooling plates in the stacking direction of the cooling plates to connect the penetration hole parts with each other.

2. The heat exchanger according to claim 1, wherein when the spacer plate and the cooling plate opposing the spacer plate are defined as one layer, the unification part is prepared in all layers or a part of the layers.

3. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites a part of the spacer plate and a part of the cooling plate opposing the spacer plate, the spacer plate has an end adjacent to at least the inflow port, and the end has a wall part bent toward the cooling plate, the unification part is a nail part that is a tip end of the cooling plate bent toward the wall part and united with the wall part, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the plurality of spacer plates has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, and the pillar structure part is defined by the first cup part and the second cup part from the most top layer to the most bottom layer of the cooling plates in the stacking direction of the cooling plates to connect the penetration hole parts with each other.

4. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites a part of the spacer plate and a part of the cooling plate opposing the spacer plate, the spacer plate has an end adjacent to at least the inflow port, and the end has a wall part bent toward the cooling plate, the unification part is the wall part united with the cooling plate, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the plurality of spacer plates has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, and the pillar structure part is defined by the first cup part and the second cup part from the most top layer to the most bottom layer of the cooling plates in the stacking direction of the cooling plates to connect the penetration hole parts with each other.

5. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites a part of the spacer plate and a part of the cooling plate opposing the spacer plate, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the spacer plate has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, the penetration hole part has a shape that covers a whole of the first cup part or a whole of the second cup part of the cooling plate, and the unification part is the penetration hole part united with the whole of the first cup part or the whole of the second cup part.

6. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites a part of the spacer plate and a part of the cooling plate opposing the spacer plate, the unification part is the spacer plate that fills a gap between the cooling plates adjacent to each other, and is united with both of the cooling plates adjacent to each other, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the plurality of spacer plates has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, and the pillar structure part is defined by the first cup part and the second cup part from the most top layer to the most bottom layer of the cooling plates in the stacking direction of the cooling plates to connect the penetration hole parts with each other.

7. A heat exchanger comprising:

a duct having an inflow port and an outflow port, a first fluid being introduced from the inflow port and discharged out of the outflow port;

a core part housed in the duct and including a plurality of cooling plates having a first plate portion and a second plate portion stacked with each other, a channel for a second fluid being defined between the first and second plate portions, a plurality of spacer plates supported between the cooling plates adjacent to each other, heat being exchanged between the first fluid flowing through the duct and the second fluid flowing through the plurality of cooling plates; and a fix plate having a frame shape corresponding to an open form of the inflow port and the outflow port, the fix plate being fixed to the inflow port and the outflow port, a tank being fixed to a side of the fix plate opposite from the duct, wherein the core part has a unification part that unites the spacer plates adjacent to each other, each of the cooling plates has a first cup part and a second cup part stacked with each other, the first cup part being a part of the first plate portion projected away from the second plate portion and having an opening, the second cup part being a part of the second plate portion corresponding to the first cup part and projected away from in an opposite direction of the first cup part and having an opening, the plurality of spacer plates has a penetration hole part that defines a pillar structure part in which the plurality of cooling plates are connected from a most top layer to a most bottom layer through the first cup part and the second cup part, the penetration hole part being interposed between the second cup part of one cooling plate and the first cup part of the adjacent cooling plate in the stacking direction of the cooling plates, and the pillar structure part is defined by the first cup part and the second cup part from the most top layer to the most bottom layer of the cooling plates in the stacking direction of the cooling plates to connect the penetration hole parts with each other.

8. The heat exchanger according to claim 7, wherein when the spacer plates adjacent to each other are defined as one layer, the unification part is prepared in all layers or a part of the layers.

9. The heat exchanger according to claim 1, wherein the unification part is a holding part different from the cooling plate and the spacer plate.

10. The heat exchanger according to claim 1, wherein the unification part is united by brazing, adhesion or welding.

11. The heat exchanger according to claim 1, wherein the unification part is united by press-fitting or plastically deforming to fix.

12. The heat exchanger according to claim 1, wherein the tank is fixed on the fix plate in a direction perpendicular to the stacking direction of the cooling plates, and the first plate portion and the second plate portion are stacked in the stacking direction of the cooling plates.

13. The heat exchanger according to claim 1, wherein the pillar structure part defines a continued passage extending from the most top layer to the most bottom layer in the stacking direction of the cooling plates, and is formed by the first cup part and the second cup part.

14. The heat exchanger according to claim 1, wherein the tank comprises a first tank being fixed to a side of a first fix plate opposite from the duct and a second tank being fixed to a side of a second fix plate opposite from the duct, the first tank being opposite from the second tank and the duct being disposed therebetween.

* * * * *